US011976913B2

(12) United States Patent
Shustov

(10) Patent No.: US 11,976,913 B2
(45) Date of Patent: May 7, 2024

(54) BOREHOLE PLUGGING DEVICE

(71) Applicant: Mining Technologies RT JSC, Krasnoyarsk (RU)

(72) Inventor: Aleksejj Niklaevich Shustov, Krasnoyarsk (RU)

(73) Assignee: Mining Technologies RT JSC, Krasnoyarsk (RU)

( * ) Notice: Subject to any disclaimer, the term of this patent is extended or adjusted under 35 U.S.C. 154(b) by 1303 days.

(21) Appl. No.: 16/484,671

(22) PCT Filed: Dec. 19, 2017

(86) PCT No.: PCT/RU2017/000951
§ 371 (c)(1),
(2) Date: Dec. 2, 2019

(87) PCT Pub. No.: WO2018/147763
PCT Pub. Date: Aug. 16, 2018

(65) Prior Publication Data

US 2020/0132424 A1 Apr. 30, 2020

(30) Foreign Application Priority Data

Feb. 13, 2017 (RU) ..... RU2017104486

(51) Int. Cl.
*F42D 1/18* (2006.01)
*E21B 33/12* (2006.01)

(52) U.S. Cl.
CPC ..... *F42D 1/18* (2013.01); *E21B 33/12* (2013.01)

(58) Field of Classification Search
CPC ..... F42D 1/08; F42D 1/18; F42D 1/00; F42D 3/04; E21B 33/12; E21B 33/10
(Continued)

(56) References Cited

U.S. PATENT DOCUMENTS 2,129,439 A * 9/1938 Noble ..... F42D 1/18 411/33
2,449,645 A * 9/1948 Du Pont ..... F42D 1/18 220/233

(Continued)

FOREIGN PATENT DOCUMENTS

CA 2741802 A1 1/2012
WO 2004/088239 A1 10/2004

OTHER PUBLICATIONS

"PCT International Search Report and Written Opinion" dated Jun. 29, 2018 (Jun. 29, 2018), for PCT Application No. PCT/RU2017/000951, 5pp.

*Primary Examiner* — James S Bergin
(74) *Attorney, Agent, or Firm* — Defillo & Associates, Inc; Evelyn A. Defillo

(57) ABSTRACT

The invention relates to the field of drilling and blasting operations, and more particularly to confining gaseous explosion products in a charge cavity, and can be used in rock blasting using borehole charges. The technical result of the invention is that of reducing the specific charge of explosive per cubic metre of blasted rock mass, increasing the fragmentation of the rock mass, making it possible for explosive to be loaded into and work effectively in a borehole with excess water pressure (flooded boreholes), providing ease of use and structural simplicity, providing ease of transportation and storage since the device can be dismantled to compact dimensions, and reducing the weight of the structure. A further technical result is the possibility of using devices of a single type in boreholes of different lengths and types (flooded or non-flooded), thus making it possible for the claimed device to be used as a universal device for all types of boreholes. The above-mentioned technical result is achieved in that the claimed borehole plugging device, which is made of a pliable polymer mate- (Continued)

rial and has elements with a shape, the outside diameter of which is commensurate with the diameter of a borehole, and an axial internal cavity, is characterized in that it consists of a rod with a cruciform cross section, having identical dome-shaped, slotted elements fixably mounted thereon from each end.

6 Claims, 5 Drawing Sheets

(58) Field of Classification Search
USPC ..... 102/304, 333
See application file for complete search history.

(56) References Cited

U.S. PATENT DOCUMENTS

| | | | | | |
|---|---|---|---|---|---|
| 2,916,995 | A * | 12/1959 | Douglass | F42D 1/18 | 102/333 |
| 3,952,656 | A * | 4/1976 | Fox | F42D 1/26 | 102/304 |
| 5,841,060 | A * | 11/1998 | Skaggs | F42D 1/18 | 102/333 |
| 9,816,794 | B1 * | 11/2017 | Rice | F42D 1/18 | |
| 10,577,886 | B2 * | 3/2020 | Phillips | F16L 55/1141 | |

* cited by examiner

Curve No. 01.

250 mm borehole, 11 m deep, 7 m charge without tamping of soil and mains charger. Charged with Granulit-1 ASP based on porous ammonia nitrate from city of Angarsk. Rate is 4187 m/s.

Curve No. 02.

250 mm borehole, 11 m deep, 7 m charge with tamping of soil and mains charger. Charged with Granulit-1 ASP based on porous ammonia nitrate from city of Angarsk. Rate is 4079 m/s.

Curve No. 03.

250 mm borehole, 11 m deep, 7 m charge with tamping of mains charger without soil. Charged with Granulit-1 ASP based on porous ammonia nitrate from city of Angarsk. Rate is 4014 m/s.

BOREHOLE PLUGGING DEVICE

CROSS REFERENCE TO RELATED APPLICATION

This application is a national stage entry of PCT/RU2017/000951, filed Dec. 19, 2017, under the International Convention and claiming priority over Russian Patent Application No. 201704486, filed Feb. 13, 2017.

FIELD OF THE INVENTION

The invention refers to the sphere of drilling sod blasting operations, in particular, to the confining of the gaseous explosion products in the charge cavity, and can be used in rock blasting with borehole charges.

BACKGROUND OF THE INVENTION

Well-known is borehole stemming with small stuff, etc. Increasing the exposure time of the blasted rock mass to the expending gaseous explosion products (B. N. Kutuzov Blasting operations. M., Nedra, 1988, p.223).

Stemming of big diameter boreholes is also known (RF Patent No. 2122178, 6 F 42 D Jan. 20, 1998) with a cylinder with internal hollow of hemispherical shape aligned with frustum, the material of which includes a salt of an alkaline earth metal (prototype). The stem is made of high-pressure polyethylene as a plasticizing agent.

The drawback of such a structure is rather rigid external surface of the item. Since different rock types have different drill-ability and quality of the borehole internal surface, this leads to difficulties of the stem positioning inside the borehole. In addition, increased stem diameters require increased materiel quantities for manufacturing of one item, with a consequence of increased item price, whereas the existing methods of dye-casting and molding do not allow for fast manufacturing of large batches of such items with high quality.

The closest similar item is borehole stem (Patent RU2223S84, published on May 5, 2004), made of pliable polymer material, of cylindrical shape, with OD commensurate with the borehole diameter, with axial protruded hemispherical inner cavity in conjunction with frustum, immediately adjoining the explosive charge, with a difference of the cylinder being a hollow and thin wall type, thereby the above-mentioned axial inner cavity has a shape of a thin-wall funnel of the wall thickness equal to that of the cylinder walls and made of the same material, thereby the gap between the funnel and the cylinder is filled with inert material. The prototype allows for increased efficiency and reduced costs of drilling and blasting operations by confining the explosion products in the charge cavity up to the complete destruction of the rock mass.

The known solutions have common problems, such as complicated design, inconvenience of shipment and storage due to poor dismount-ability to compact-size pieces, relatively heavy weight of the stemming, and poor efficiency of the borehole charge.

SUMMARY OF THE INVENTION

It is the goal of the invention to rectify the above-stated drawbacks by means of replacement of the currently practiced technique of borehole stemming by the subject borehole plugging device.

The technical result of the invention is that of the reduced specific charge of explosive per one cubic meter of blast rock, and increased fragmentation of the rock mass, making it possible for explosives to be loaded into and work effectively in a borehole with excess water pressure (flooded boreholes), providing ease of use and structural simplicity, providing ease of transportation and storage, since the device can be dismantled to compact dimensions, and reducing the weight of the structure.

A further technical result is the possibility of using devices of a single type in boreholes of different lengths and types (flooded or non-flooded), thus making It possible for the claimed device to be used as a universal device for all types of boreholes.

The above-mentioned technical result is achieved in that the claimed borehole plugging device having a rod made of a pliable polymer material and includes dome shaped elements attached to the rod. The outside diameter of the dome shaped elements is commensurate with the diameter of a borehole. The rod with a cross section having cross shape. The rod has identical dome-shaped elements fix-mounted thereon from each end. Preferably, the dome-shaped elements contain flanges by means of which they are fixed in the dents of the rod. Preferably, the dome-shaped elements include protrusions. The protrusions are preferably of varying length, with each long protrusions between two short protrusions.

Preferably, 2 to 4 dome-shaped elements are fed on one rod. Preferably, the dome elements are shaped with symmetrical arrangement of slots.

Figure 1:
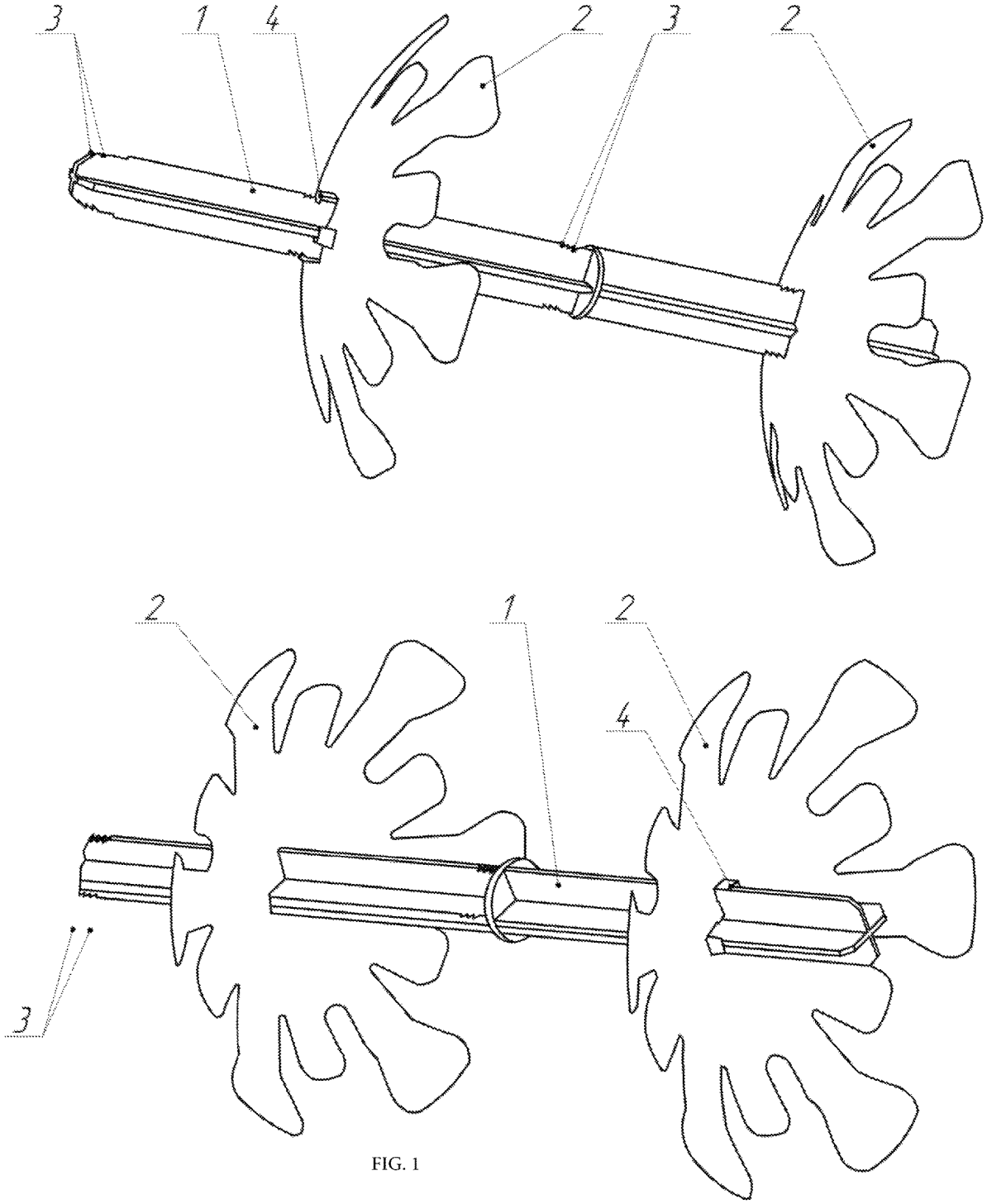
FIG. 1 shows the borehole plugging device in one of possible design variants from different points of view in 3D.

In the drawings: 1—rod, 2—dome-shaped element, 3—rod dent, 4—flange of the dome-shaped element for seat on the dent, 5—ignition channel, 6—discharge channel, 7—big contact, 8—small contact.

DETAILED DESCRIPTION OF THE INVENTION

Stemming is the process of filling with inert material of a part of the charge cavity; the inert material itself used to confine the explosive charge, to reduce the scattering range of the splitters is also called "stemming". Stemming is used to "lock" the explosion products, to increase the efficiency of the explosion. The borehole plugging device, as stated in the claimed solution, is a replacement for the existing method of stemming.

The borehole plugging device (see FIG. 1) consists structurally of three elements: the rod (1) and at least two dome-shaped elements (2), one of which is fixed on the rod from one end and the other one on the other rod end. The cross-section of the rod is cruciform. Such solution allows for the required strength of the structure with simultaneous reduction of the material quantity for the manufacturing of the rod. Thus, the weight of the structure is less, whereas the manufacturing is simplified.

Figure 2:
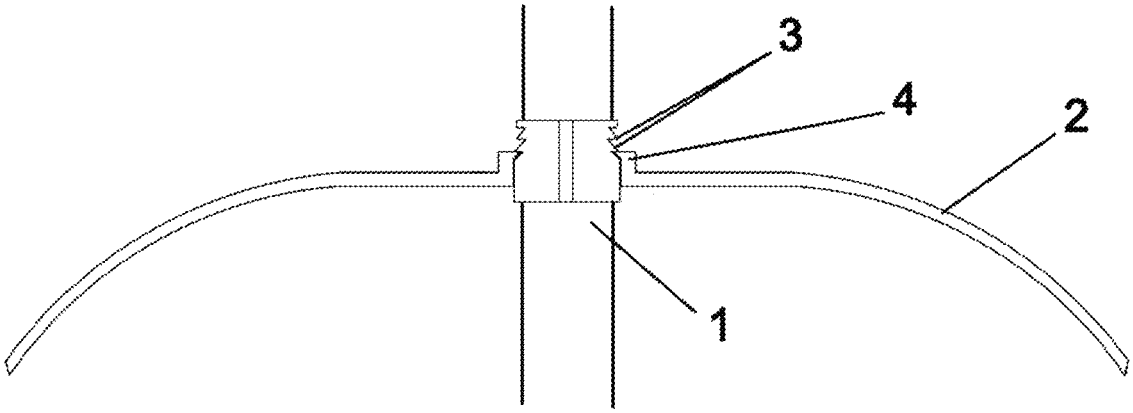
FIG. 2 shows the principle of the conjunction of the dome-shaped element on the rod.

For fixation of the dome-shaped elements (2), the rod (1) can feature dents (3) (notches) in the places of the upper and the lower connection of the dome-shaped elements. For attaching the dome-shaped elements (2) to the rod (1), the dome-shaped elements (2) include flanges (4) that are secure to the dents on the rod (see FIG. 2).

The rod (2) of the borehole plugging device may have two to four dome-shaped elements (2). Also, the rod design provides for using the borehole plugging device completely assembled within a large range of diameters. Thus, the fragmentation of the rock mass in the open terrain depends on a multitude of factors, e.g., the geology, the type of the explosive utilized, the development design, the drilling equipment, or on the diameters of the boreholes drilled. The operation diameters of the borehole plugging device are assigned to the borehole diameters ranging from 65 to 270 mm. The rod of the structure is unchangeable, whereas the protrusions get together on the rod depending on the borehole diameter.

Figure 3:
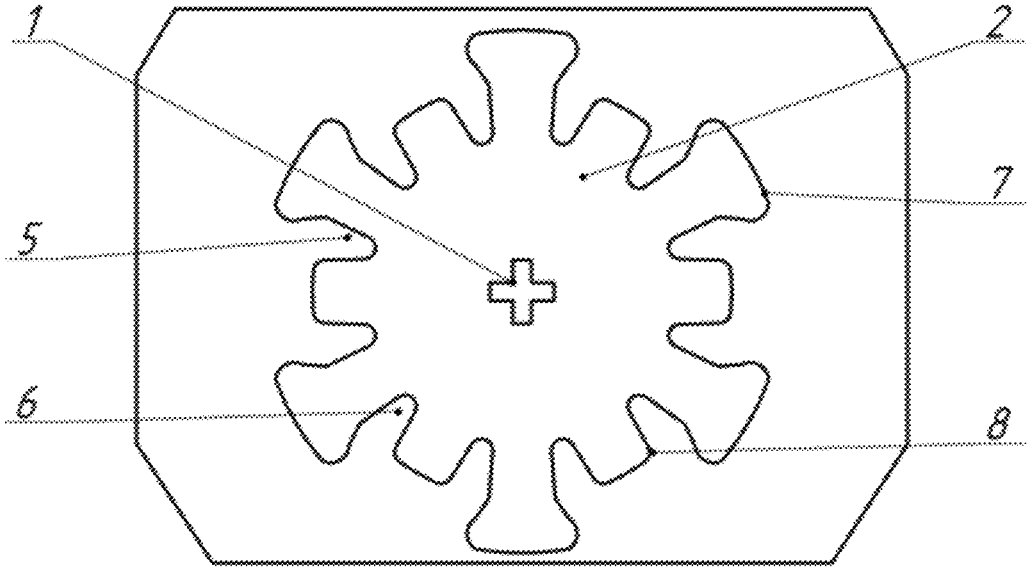
FIG. 3 shows an example of the fitting of the borehole plugging device in a borehole.

In flooded boreholes, or where the borehole length exceeds 15 m, 3 to 4 dome-shaped elements with slots are mounted on the rod. These slots can also be of protrusion shape, also including those that are symmetrical, relative to the center axis. At protrusions of different length, with the arrangement of each long lobs between the short ones, the slots of the structure of the borehole plugging device ensure at fitting in the borehole such structural features, which are shown in FIG. 3—fitting of the borehole plugging device in the borehole. The big contact (7) goes through the big protrusion, and the small contact (8) goes through the small protrusion. In the slots between the protrusions, there is the discharge channel (6), letting out the shock wave from the ignition channel (5).

The slots, e.g. as protrusions of the borehole plugging device, are intended for direct contact with the borehole walls in such structure with diameters ranging from 130 to 170 mm. The small contacts (8) ensure optimal angle of attack and angle of resistance, within the range of diameters 130 to 150 mm.

The big contacts (7) ensure optimal angle of attack and angle of resistance within the range of diameters of 150 to 170 mm. The design of the borehole plugging device envisages channels for ignition means (5), whereas such solution protects the ignition means during the propulsion of the structure through the borehole.

The discharge channel (6) is intended for discharge of the initial pressure (piston effect). In case of a borehole with excessive water pressure, the discharge channels let the water flow, but the explosive remains in the charge cavity of the borehole.

In the course of experimental tests on industrial basis in the enterprises of the mining branch, the borehole plugging device utilized in the borehole charges as a stemming device, has demonstrated the following results:

reduced specific charge of explosive per cubic meter of blasted rock mass;

increased fragmentation of the rock mass;

possibility of charging and full-scale operation of the explosive in a borehole with excessive water pressure (flooded boreholes);

comfort in use, shipment, and storage, due to dismantling down to compact dimensions; and reduced weight of the structure.

Figure 4:
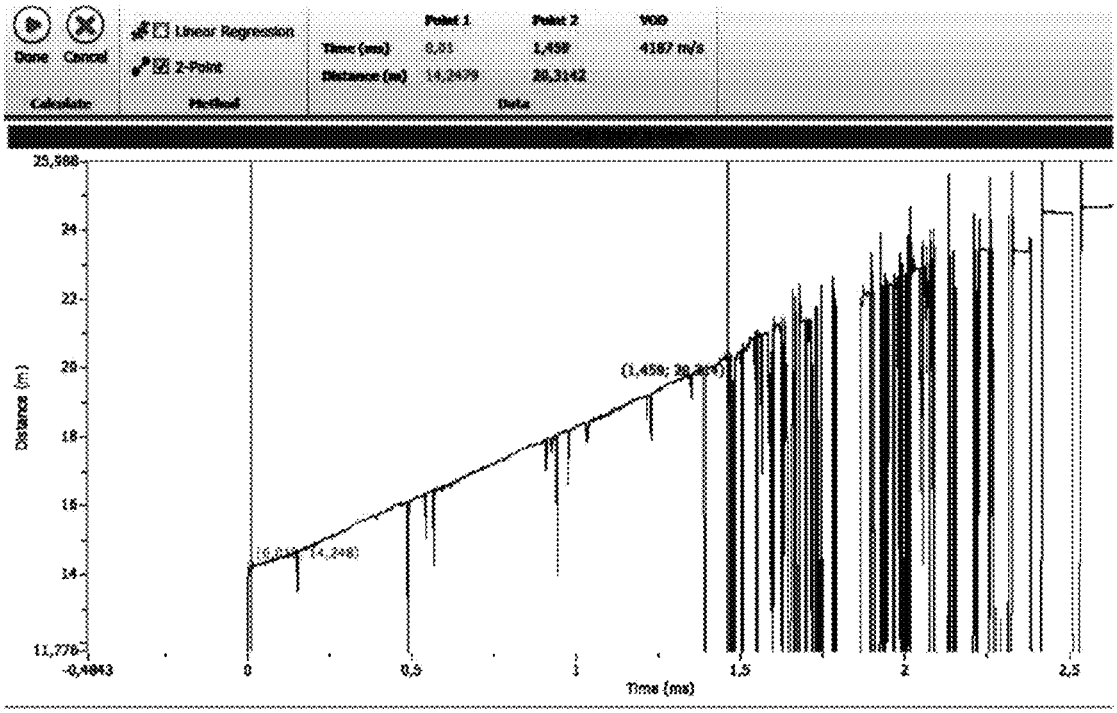
FIG. 4 to FIG. 6 show measurement protocols of experimental blasting, using the borehole slugging device.
Figure 5:
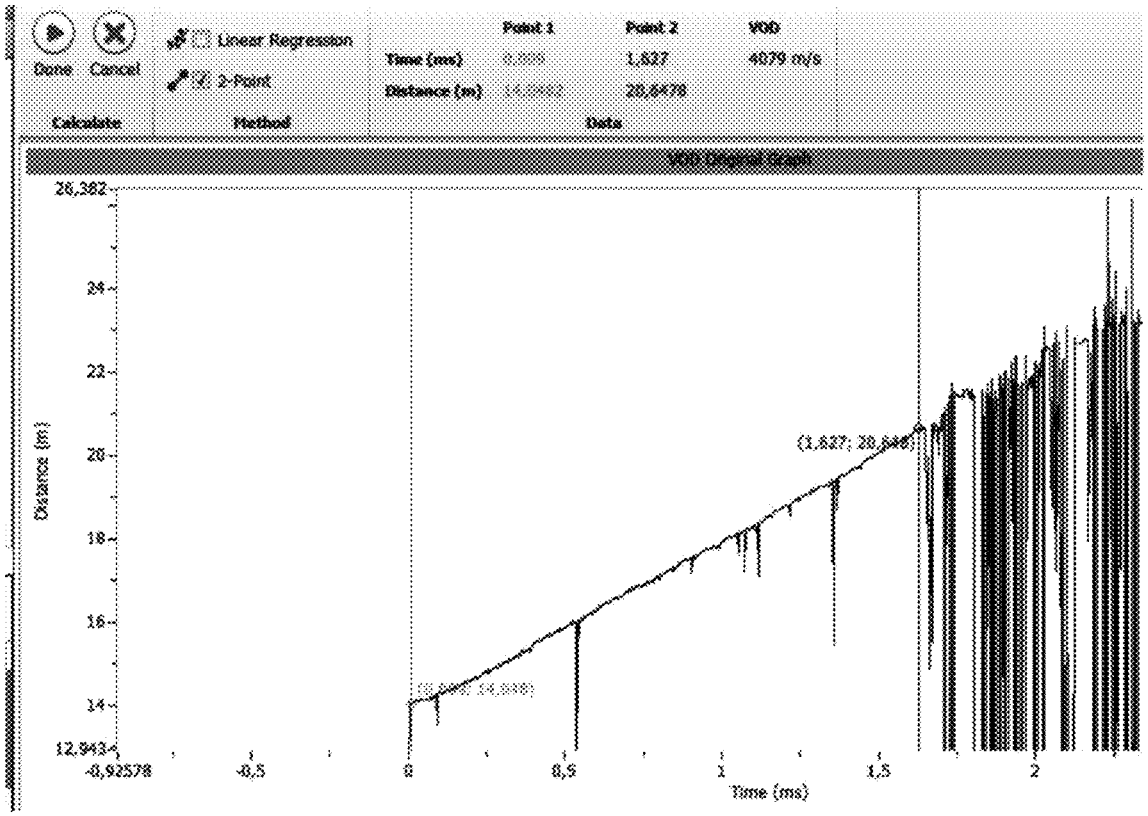
Figure 6:
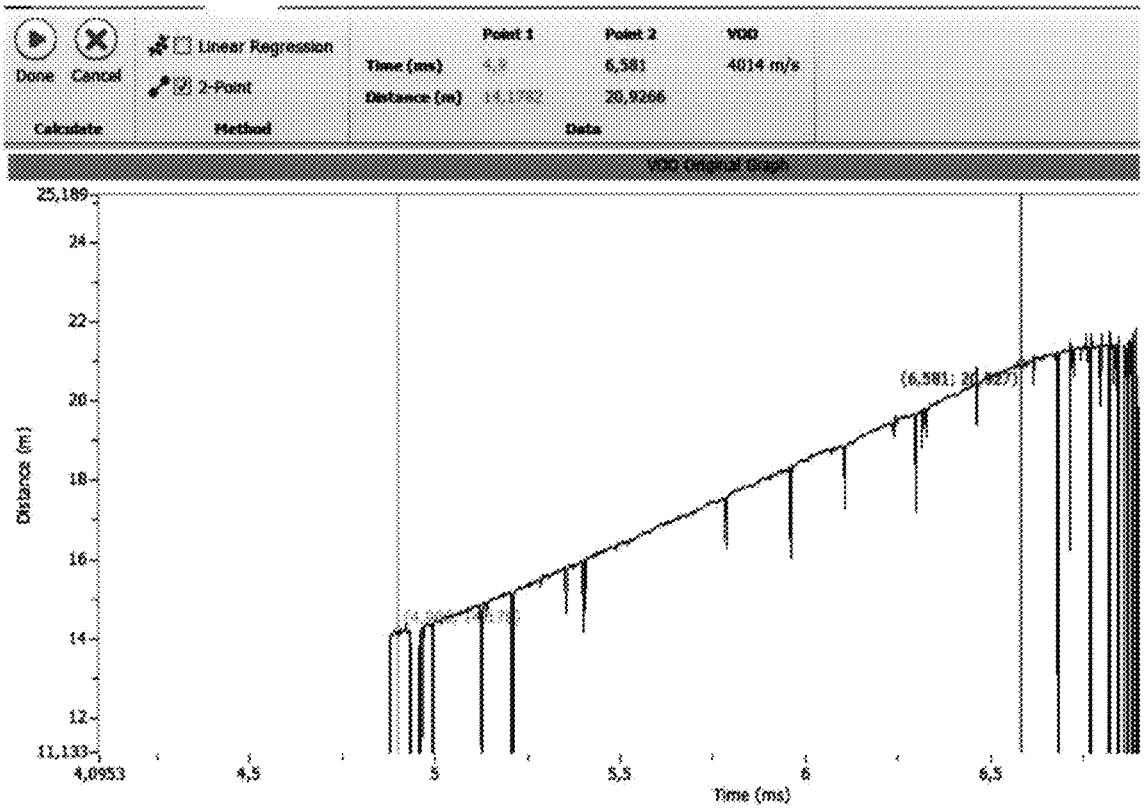

FIG. 4 to FIG. 6 shows the results of the measurement during tests of the borehole plugging device. They demonstrate that the detonation velocity in the experimental boreholes is almost the same, however slightly slower detonation is observed in boreholes with the borehole plugging device.

The invention claimed is:

1. A borehole plugging device comprising:

a rod made of a pliable polymer material, the rod having a first end and a second end and a length extending between the first end and the second end of the rod;

a plurality of notches spaced at intervals along the length of the rod;

a first dome-shaped element attached at one of the plurality of notches at the first end of the rod and having an outer diameter which is commensurate with a diameter of a borehole;

a second dome-shaped element attached at another one of the plurality of notches at the second end of the rod and having an outer diameter which is commensurate with the diameter of the borehole;

wherein the rod has a cross section having a shape of a cross along the length between the first end and the second end of the rod.

2. The borehole plugging device according to claim 1, wherein the first and the second dome-shaped elements include flanges, the first and the second dome-shaped elements are secured to the rod by attaching the flanges to the corresponding notches.

3. The borehole plugging device according to claim 1, wherein each one of the first and the second dome-shaped elements include a plurality of projections having different lengths.

4. The borehole plugging device according to claim 3, wherein the projections are arranged on the dome-shaped elements by alternating a short-length projections between two long-length projections.

5. The borehole plugging device according to claim 1, further comprising a third dome-shaped element and a fourth dome-shaped element attached to the rod.

6. The borehole plugging device according to claim 1, wherein the dome-shaped elements comprise a symmetrical arrangement of slots.

* * * * *